US011446934B2

(12) United States Patent
Miura et al.

(10) Patent No.: US 11,446,934 B2
(45) Date of Patent: Sep. 20, 2022

(54) PRINTING DEVICE CONFIGURED TO SEPARATE SHEET INTO FIRST SHEET AND SECOND SHEET, DISCHARGE FIRST SHEET, AND REUSE SECOND SHEET

(71) Applicant: BROTHER KOGYO KABUSHIKI KAISHA, Nagoya (JP)

(72) Inventors: Katsuro Miura, Toyota (JP); Takashi Ohama, Iwakura (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 43 days.

(21) Appl. No.: 17/168,308

(22) Filed: Feb. 5, 2021

(65) Prior Publication Data

US 2021/0245525 A1 Aug. 12, 2021

(30) Foreign Application Priority Data

Feb. 6, 2020 (JP) ..... JP2020-018885

(51) Int. Cl.
*B41J 11/70* (2006.01)
*B65H 29/60* (2006.01)
(Continued)

(52) U.S. Cl.
CPC ..... *B41J 3/60* (2013.01); *B41J 11/663* (2013.01); *B41J 11/70* (2013.01); *B41J 29/38* (2013.01); *B65H 7/02* (2013.01); *B65H 29/60* (2013.01); *B65H 85/00* (2013.01); *B41J 13/009* (2013.01); *B65H 2301/33312* (2013.01);
(Continued)

(58) Field of Classification Search
CPC ... B41J 3/60; B41J 11/663; B41J 11/70; B41J 29/38; B41J 13/009; B65H 7/02; B65H 29/60; B65H 85/00; B65H 2301/33312; B65H 2301/3423; B65H 2301/5151; B65H 2801/03
See application file for complete search history.

(56) References Cited

U.S. PATENT DOCUMENTS

2013/0140761 A1* 6/2013 Uchino ..... B41J 13/103 271/147

FOREIGN PATENT DOCUMENTS

JP S59-194944 A 11/1984
JP 04071873 A * 3/1992 ..... B65H 5/06
(Continued)

*Primary Examiner* — Yaovi M Ameh
(74) *Attorney, Agent, or Firm* — Scully, Scott, Murphy & Presser, PC

(57) ABSTRACT

A printing device includes: a feeding tray on which a sheet can be mounted; a first conveying passage; an image forming unit disposed along the first conveying passage and configured to record an image on the sheet; a cutting unit disposed along the first conveying passage downstream of the image recording unit and configured to cut the sheet; a second conveying passage connected to the first conveying passage; and a controller configured to perform: conveying the sheet mounted on the feeding tray to the image recording unit; recording an image on the sheet by the image recording unit; cutting the recorded sheet at a cutting position on the sheet to divide the sheet into a first sheet on which the image has been recorded and a second sheet on which the image has not been recorded; discharging the first sheet; and conveying the second sheet to the second conveying passage.

18 Claims, 9 Drawing Sheets

(51) Int. Cl.

| | |
|---|---|
| ***B41J 29/38*** | (2006.01) |
| ***B41J 13/00*** | (2006.01) |
| ***B41J 3/60*** | (2006.01) |
| ***B65H 7/02*** | (2006.01) |
| ***B41J 11/66*** | (2006.01) |
| ***B65H 85/00*** | (2006.01) |

(52) U.S. Cl.
CPC ..... *B65H 2301/3423* (2013.01); *B65H 2301/5151* (2013.01); *B65H 2801/03* (2013.01)

(56) References Cited

FOREIGN PATENT DOCUMENTS

| | | | | | |
|---|---|---|---|---|---|
| JP | H04-071873 | A | | 3/1992 | |
| JP | H05-268409 | A | | 10/1993 | |
| JP | 2011-121777 | A | | 6/2011 | |
| JP | 2011121777 | A | * | 6/2011 | ..... B65H 3/44 |
| JP | 2018-186448 | A | | 11/2018 | |

* cited by examiner

PRINTING DEVICE CONFIGURED TO SEPARATE SHEET INTO FIRST SHEET AND SECOND SHEET, DISCHARGE FIRST SHEET, AND REUSE SECOND SHEET

CROSS REFERENCE TO RELATED APPLICATION

This application claims priority from Japanese Patent Application No. 2020-018885 filed Feb. 6, 2020. The entire content of the priority application is incorporated herein by reference.

TECHNICAL FIELD

The present disclosure relates to a printing device.

BACKGROUND

A conventional image forming apparatus is provided with an image forming unit for forming images on sheets, and a sheet conveying unit for conveying sheets to the image forming unit. When the image forming apparatus receives a job, the sheet conveying unit conveys a sheet in a sheet feeding cassette to the image forming unit, and the image forming unit forms an image on the sheet. At this time, the size of the sheet specified by the job may be smaller than the size of the sheets loaded in the sheet feeding cassette. In such cases, a user must reload sheets having the size specified in the job, which is an inconvenience for the user.

One conventional image forming apparatus described in Japanese Patent Application Publication No. 2018-186448 is capable of feeding first sheets and second sheets that are larger than the first sheets. If the image forming apparatus is out of first sheets that is specified by a job, the image forming apparatus forms an image on a second sheet, and cuts the second sheet in half to generate a sheet on which the image has been formed and a blank sheet those have the size the same the first sheet. The image forming apparatus then respectively discharges the sheet on which the image has been formed and the blank sheet onto separate discharge trays.

SUMMARY

In the description of Japanese Patent Application Publication No. 2018-186448, blank sheets discharged onto the discharge tray are returned to a first feeding cassette for reuse. However, when blank sheets that have been cut are conveyed from the first feeding cassette to the sheet conveying unit, the cut sheets can easily become entangled with the first feed roller, resulting in paper jams or other problems in which the cut sheets are not properly conveyed.

In view of the foregoing, it is an object of the present disclosure to provide a printing device that can reliably use sheets after they have been cut.

In order to attain the above and other object, according to one aspect, the present disclosure provides a printing device including: a feeding tray on which a sheet can be mounted; a first conveying passage in which the sheet is conveyed in a first conveying direction; an image forming unit; a cutting unit; a second conveying passage in which the sheet is conveyed in a second conveying direction different from the first conveying direction; and a controller. The image recording unit is disposed along the first conveying passage and configured to record an image on the sheet. The cutting unit is disposed along the first conveying passage at a position downstream of the image recording unit in the first conveying direction. The cutting unit is configured to cut the sheet. The second conveying passage is connected to the first conveying passage at a merging position on the first conveying passage positioned upstream of the image recording unit in the first conveying direction. The controller is configured to perform: (a) conveying the sheet mounted on the feeding tray to the image recording unit; (b) recording, using the image recording unit, an image on the sheet; (c) cutting, using the cutting unit, the sheet on which the image has been recorded in the (b) recording at a cutting position on the sheet to divide the sheet into a first sheet on which the image has been recorded and a second sheet on which the image has not been recorded, (d) discharging the first sheet to an outside; and (e) conveying the second sheet to the second conveying passage.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

<Configuration of Printing Device>

Figure 1:
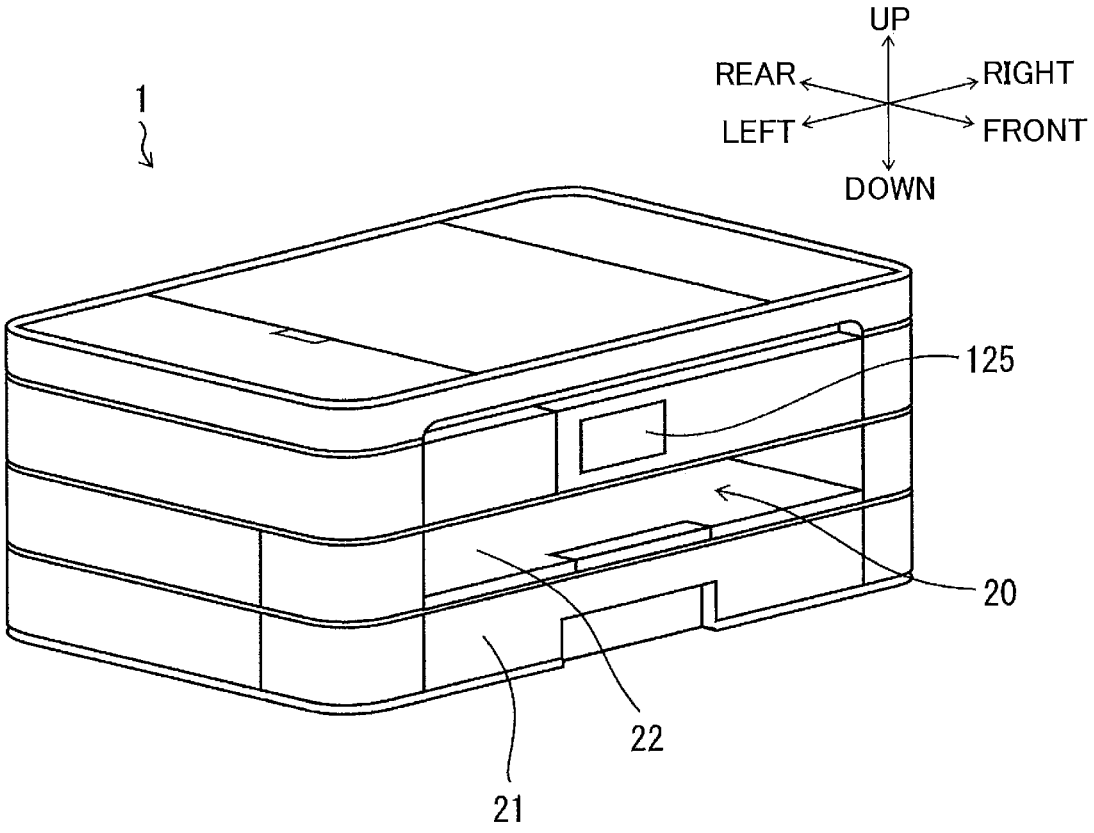
FIG. 1 is a view illustrating an external appearance of a printing device according to one embodiment of the present disclosure.
Figure 2:
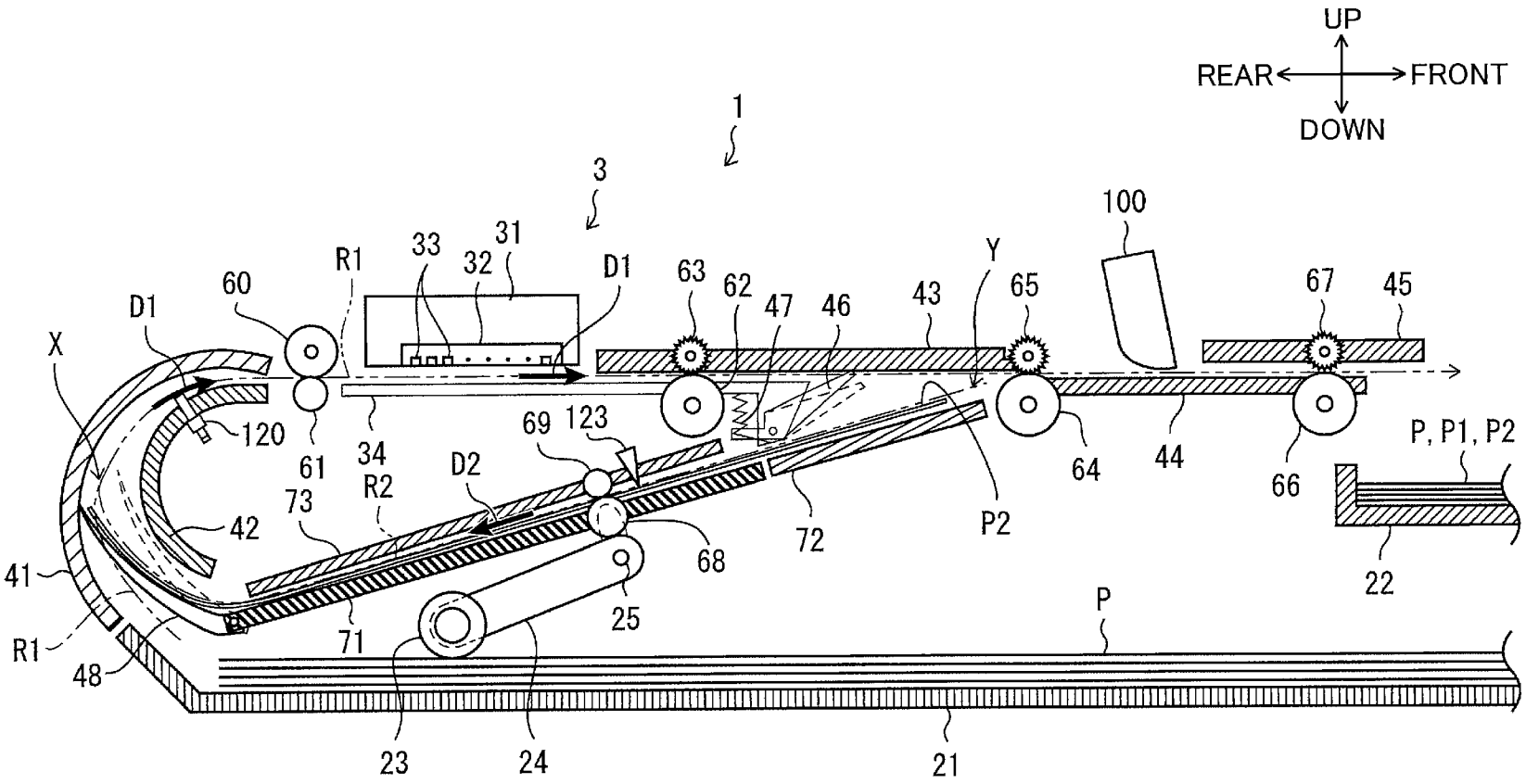
FIG. 2 is a cross-sectional view illustrating an internal configuration of the printing device according to the embodiment.

Hereinafter, a printing device 1 according to one embodiment of the present disclosure will be described with reference to FIGS. 1 through 9. FIG. 1 illustrates an external appearance of the printing device 1 according to the embodiment. FIG. 2 is a cross-sectional view illustrating an internal configuration of the printing device 1.

The printing device 1 in FIG. 1 is a multifunction peripheral (MFP) having a plurality of functions, such as a printing function, a scanning function, a copying function, and a facsimile function. For convenience, an up-down direction, a left-right direction, and a front-rear direction with reference to the printing device 1 are defined as indicated by arrows in FIG. 1.

The printing device 1 has an inkjet printing function for recording print data specified in a print job on sheets P by ejecting ink, for example. However, method of printing is not limited to the inkjet method but may be the electrophotographic method. The printing device 1 may be capable of printing color images or only monochromatic images on sheets P. The sheets P may be a paper medium or a resin medium such as transparency sheets.

As illustrated in FIG. 1, the printing device 1 has a front surface formed with an opening 20. A feeding tray 21 and a discharging tray 22 are detachably mounted in the opening 20. The feeding tray 21 is open upward and configured to accommodate therein a plurality of sheets P. Size of the sheets P may be the A4-size, for example. As illustrated in FIG. 2, the discharging tray 22 is disposed above the feeding tray 21. The discharging tray 22 is also open upward and is provided for accommodating sheets P (as well as first sheets P1 or second sheets P2 described later) that are discharged from the printing device 1.

An operating unit 125 having a display screen is also provided on the front surface of the printing device 1. The operating unit 125 is configured of a touchscreen, for example. Through touch operations on the touchscreen, a user can perform various settings for printing on the printing device 1 and can enter input information. Input information entered through operations on the operating unit 125 is outputted to a controller 10 via an input unit 126 (see FIG. 3).

The input unit 126 receives such input information as the size of the sheets P (a width and/or a length of a sheet P), information related to the type of the sheets P accommodated in the feeding tray 21 (normal paper, glossy paper, thick paper, and the like) and input indicating whether to execute a second conveying process (described later).

As illustrated in FIG. 2, the printing device 1 further includes a feeding roller 23, a feeding arm 24, a first conveying passage R1, first conveying rollers 60 and 62, a reversing roller 64, a discharging roller 66, a second conveying roller 68, a first flap 46, a second flap 48, a second conveying passage R2, an image recording unit 3, and a cutting unit 100. The numbers of rollers provided along the first conveying passage R1 and the second conveying passage R2 may be arbitrary.

The feeding roller 23 functions to convey sheets P accommodated in the feeding tray 21 onto the first conveying passage R1. The feeding roller 23 is rotatably supported on a distal end of the feeding arm 24. The feeding arm 24 is rotatably supported on a shaft 25 which is supported by a frame of the printing device 1. The feeding roller 23 makes forward rotation when a feeding motor 17 (see FIG. 3) is driven. By rotating forward, the feeding roller 23 can feed sheets P accommodated in the feeding tray 21 onto the first conveying passage R1 one by one.

The first conveying passage R1 is a path that extends from a rear end of the feeding tray 21 toward the discharging tray 22. The path extends upward from the rear end of the feeding tray 21, curving in a region defined by guide members 41 and 42, and then extends straight past the position of the image recording unit 3 (described later) and through a region defined by guide members 43, 44, and 45.

The first conveying roller 60 is disposed along the first conveying roller 60 upstream of the image recording unit 3 in a first conveying direction D1. A pinch roller 61 is disposed at a position below and opposing the first conveying roller 60. A conveying motor 18 (see FIG. 3) causes the first conveying roller 60 to be rotated. The pinch roller 61 is rotated following rotation of the first conveying roller 60. While a sheet P is nipped between the first conveying roller 60 and the pinch roller 61, forward rotation of the first conveying roller 60 and the pinch roller 61 causes the sheet P to be conveyed toward the image recording unit 3.

The image recording unit 3 is disposed along the first conveying passage R1 between the first conveying roller 60 and the first conveying roller 62, and is configured to record images on sheets P. The image recording unit 3 includes a carriage 31, a recording head 32, a plurality of nozzles 33, and a platen 34. The recording head 32 is mounted on the carriage 31. The recording head 32 has a lower surface on which the plurality of nozzles 33 is formed, and is configured to eject ink droplets through the nozzles 33.

The platen 34 is a rectangular plate-shaped member that supports the sheets P as the sheets P are conveyed along the first conveying passage R1 beneath the image recording unit 3. The image recording unit 3 records an image on a sheet P supported on the platen 34 by controlling the recording head 32 to eject ink droplets selectively through the nozzles 33 as the carriage 31 is moved relative to the sheet P.

A carriage motor 19 (see FIG. 3) transmits a drive force to the carriage 31 for reciprocally moving the carriage 31 in directions orthogonal to the first conveying direction D1, i.e., along a width direction of the sheet P. When recording an image on a sheet P, the controller 10 repeatedly alternates between a recording process to record an image for one line on the sheet P, and a line feed process to convey the sheet P a prescribed conveyance amount.

In the recording process, the controller 10 controls the carriage 31 to be moved in the width direction of the sheet P and controls the recording head 32 to eject ink through the nozzles 33 while conveyance of the sheet P is halted. In the line feed process, the controller 10 causes the first conveying roller 60 and the first conveying roller 62 to be rotated to feed the sheet P by the prescribed conveyance amount.

As illustrated in FIG. 2, the first conveying roller 62 is disposed along the first conveying passage R1 at a position downstream of the image recording unit 3 in the first conveying direction D1. A spur roller 63 is disposed at a position above and facing the first conveying roller 62. The conveying motor 18 (see FIG. 3) drives the first conveying roller 62 to be rotated. The spur roller 63 is rotated following rotation of the first conveying roller 62. When the first conveying roller 62 and the spur roller 63 make forward rotation while a sheet P is nipped between the first conveying roller 62 and the spur roller 63, the sheet P is conveyed in the first conveying direction D1.

The reversing roller 64 is disposed along the first conveying passage R1 at a position downstream of the first conveying roller 62 in the first conveying direction D1. A spur roller 65 is disposed at a position above and facing the reversing roller 64. The reversing roller 64 is driven by the conveying motor 18 to be rotated. The spur roller 65 is rotatable along with rotation of the reversing roller 64. When a sheet P is nipped between the reversing roller 64 and the spur roller 65, forward rotation of the reversing roller 64 and the spur roller 65 cause the sheet P to be conveyed toward the cutting unit 100.

However, when the reversing roller 64 and the spur roller 65 make reverse rotation (rotated in a direction opposite a direction when making forward rotation), a sheet P nipped between the reversing roller 64 and the spur roller 65 is conveyed in a direction opposite the first conveying direction D1. The sheet P being conveyed in reverse contacts the first flap 46 and is guided along a lower surface of the first flap 46 onto the second conveying passage R2. When the sheet P is in the second conveying passage R2, the sheet P is conveyed in a second conveying direction D2.

The first flap 46 is disposed on the first conveying passage R1 between the first conveying roller 62 and the reversing roller 64. The first flap 46 is disposed near a branching position Y and opposes the guide member 43. The first flap 46 is supported by the platen 34 so as to be pivotally movable between a first state (a state indicated by solid line in FIG. 2) and a second state (a state indicated by a dashed line in FIG. 2).

When in the first state, the first flap 46 contacts the guide member 43 to close the first conveying passage R1. On the other hand, when in the second state, the first flap 46 is pivotally moved downward from the first state and separated from the guide member 43 to allow passage of a sheet P conveyed in the first conveying direction D1 thorough the first conveying passage R1.

The first flap 46 is urged upward by a coil spring 47. The coil spring 47 has one end connected to the first flap 46, and another end connected to the platen 34. Due to an urging force of the coil spring 47, the first flap 46 is maintained in the first state with its distal end contacting the guide member 43.

The cutting unit 100 is disposed along the first conveying passage R1 downstream of the reversing roller 64. The cutting unit 100 has a well-known cutter mechanism for cutting a sheet P after the image recording unit 3 has recorded an image thereon. More specifically, while a sheet P is nipped between the reversing roller 64 and the spur roller 65, and between the discharging roller 66 and a spur roller 67, the cutting unit 100 cuts through the sheet P at a prescribed position in the sheet P (hereinafter referred to as "cutting position") along the width direction of the sheet P by moving the cutter mechanism in the width direction of the sheet P.

Figure 4:
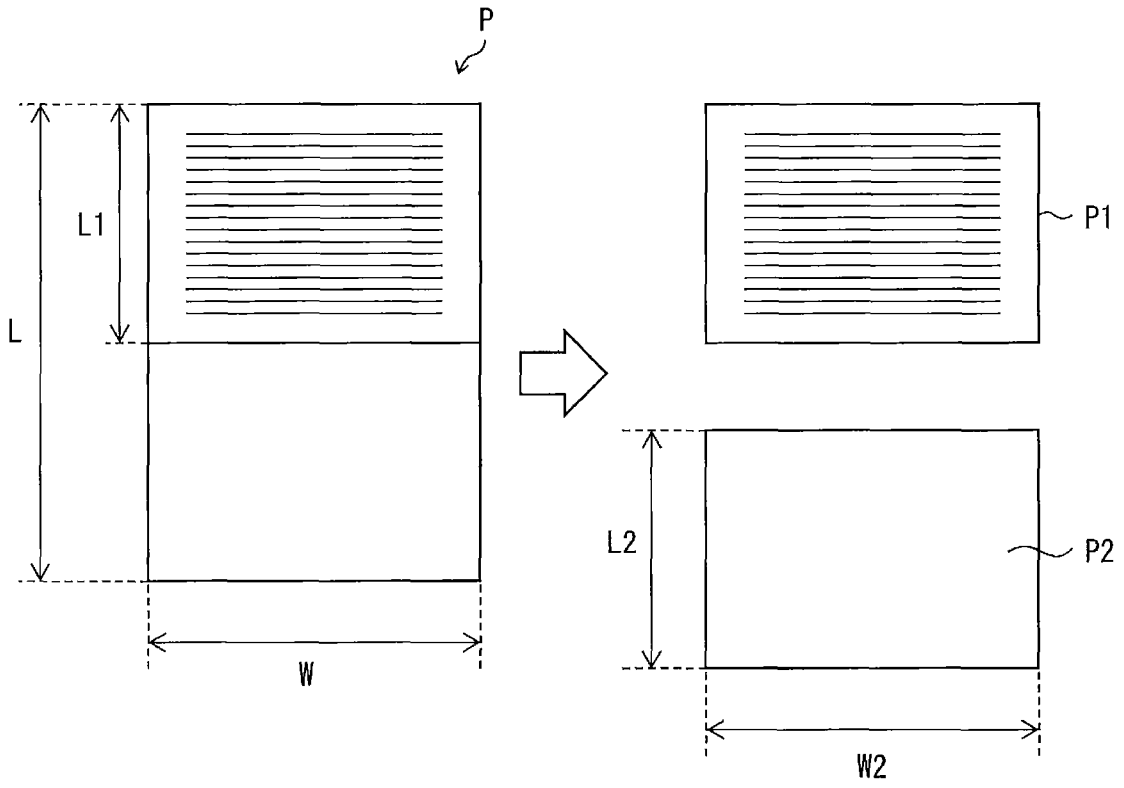
FIG. 4 is a view illustrating a sheet prior to cutting process, and first and second sheet sheets obtained by cutting the sheet.

When the controller 10 determines that a sheet P is to be cut, the controller 10 controls the cutting unit 100 to cut the sheet P at the cutting position, thereby separating the sheet P into a first sheet P1 and a second sheet P2, as illustrated in FIG. 4.

The discharging roller 66 is disposed along the first conveying passage R1 downstream of the cutting unit 100 in the first conveying direction D1. The spur roller 67 is disposed at a position above and facing the discharging roller 66. The conveying motor 18 drives the discharging roller 66 to be rotated. The spur roller 67 is rotatable following rotation of the discharging roller 66.

When a sheet P, a first sheet P1, or a second sheet P2 on which an image has been recorded is conveyed to the discharging roller 66, forward rotation of the discharging roller 66 and the spur roller 67 allow the recorded sheet P, first sheet P1, or second sheet P2 to be discharged onto the discharging tray 22. In the meantime, when an image has not been recorded onto a second sheet P2 that is generated when a sheet P is cut by the cutting unit 100, the second sheet P2 is conveyed to the second conveying passage R2.

When an image is to be recorded on the second sheet P2 in the second conveying passage R2, the second sheet P2 is conveyed back from the second conveying passage R2 into the first conveying passage R1 through a merging position X (see FIG. 2). After the image recording unit 3 records an image on the second sheet P2, the second sheet P2 is finally discharged onto the discharging tray 22.

As illustrated in FIG. 2, the second flap 48 is disposed at the merging position X between the first conveying passage R1 and the second conveying passage R2 so as to be pivotally movable. Specifically, the second flap 48 is pivotally movable between a first state (a state indicated by a solid line in FIG. 2), and a second state (a state indicated by a dashed line in FIG. 2).

When the second flap 48 is in the first state, a portion of the second conveying passage R2 is configured by the second flap 48 and the guide member 42. When the second flap 48 is in the second state, a portion of the first conveying passage R1 is configured by the second flap 48 and the guide member 41.

A registration sensor 120 is disposed on the first conveying passage R1 at a position upstream of the first conveying roller 60. The registration sensor 120 is a sheet edge sensor. That is, the registration sensor 120 detects when a leading edge or a trailing edge of a sheet P passes a position for contacting the first conveying roller 60. The registration sensor 120 may be a sensor provided with an actuator that pivots when contacted by a sheet P, a photosensor, or the like.

The registration sensor 120 is configured to output an ON signal while a sheet P is passing the position of the registration sensor 120 and to output an OFF signal while a sheet P is not passing the position of the registration sensor 120. Hence, the registration sensor 120 outputs an ON signal from the timing that the leading edge of a sheet P reaches the position of the registration sensor 120 to the timing that the trailing edge of the same sheet P passes the position of the registration sensor 120 and outputs an OFF signal at all other times. Detection signals from the registration sensor 120 are outputted to the controller 10.

A rotary encoder 121 (see FIG. 3) is provided on the first conveying roller 60 for detecting the rotation of the first conveying roller 60. The registration sensor 120 outputs a pulse signal to the controller 10 according to the rotation of the first conveying roller 60. The registration sensor 120 has an encoder disc, and an optical sensor. The encoder disc is rotatable in accordance with the rotation of the first conveying roller 60. The optical sensor is configured to generate a pulse signal while reading the rotating encoder disc, and to output the pulse signal to the controller 10.

In the present embodiment, the rotary encoder 121 is used as a sensor for detecting a conveyance amount of the second sheet P2. The controller 10 can detect the conveyance amount of the second sheet P2 on the second conveying passage R2 based on the output from the rotary encoder 121 and the gear ratio of the first conveying roller 60 and the second conveying roller 68.

The second conveying passage R2 is defined by guide members 71, 72, and 73; the second conveying roller 68 and a pinch roller 69 (described later), and the like. The second conveying passage R2 branches from the first conveying passage R1 at the branching position Y upstream of the reversing roller 64 and reconnects to the first conveying passage R1 at the merging position X upstream of the image recording unit 3 in the first conveying direction D1.

As illustrated in FIG. 2, a second sheet sensor 123 is provided along the second conveying passage R2. The second sheet sensor 123 is configured to output an ON signal to the controller 10 when a second sheet P2 is present at a position of the second sheet sensor 123 on the second conveying passage R2, and to output an OFF signal to the controller 10 when a second sheet P2 is not present at the position of the second sheet sensor 123. Hence, the second sheet sensor 123 outputs an ON signal from the timing that the leading edge of a second sheet P2 reaches the position of the second sheet sensor 123 to the timing that the trailing edge of the second sheet P2 passes the position of the second sheet sensor 123, and outputs an OFF signal at all other times.

Figure 3:
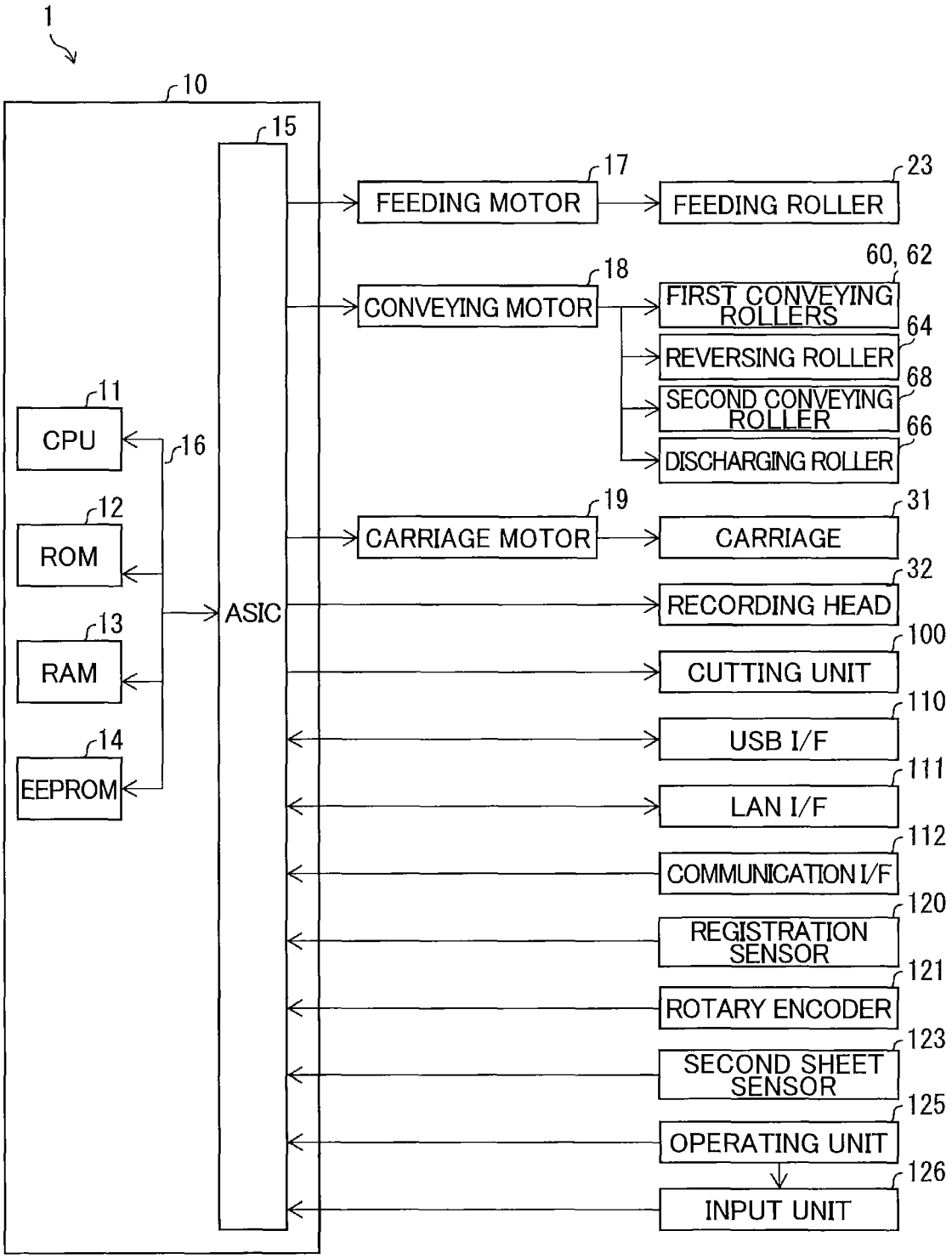
FIG. 3 is a block diagram illustrating an electrical configuration in the printing device according to the embodiment.

FIG. 3 is a block diagram illustrating an electrical configuration of the printing device 1 according to the present embodiment. In addition to the feeding motor 17, the conveying motor 18, the carriage motor 19, and the controller 10 described above, the printing device 1 includes a USB interface 110, a LAN interface 111, and a communication interface 112, as illustrated in FIG. 3.

The controller 10 includes a central processing unit (CPU) 11, a read-only memory (ROM) 12, a random-access memory (RAM) 13, an EEPROM 14 (registered trademark), and an application-specific integrated circuit (ASIC) 15 that are all interconnected via an internal bus 16.

The ROM 12 stores therein programs and the like with which the CPU 11 executes various operations. The RAM 13 is used as a storage area for temporarily storing data signals and the like used when the CPU 11 executes the programs described above, and a work area for data processing. The EEPROM 14 stores therein settings information that must be preserved after power to the printing device 1 is turned off. The controller 10 controls the feeding motor 17, the conveying motor 18, the carriage motor 19, the recording head 32, the cutting unit 100, and the like based on a control program read from the ROM 12.

The ASIC 15 is connected to the feeding motor 17, the conveying motor 18, the carriage motor 19, the recording head 32, the cutting unit 100, the USB interface 110, the LAN interface 111, the communication interface 112, the registration sensor 120, the rotary encoder 121, the second sheet sensor 123, the operating unit 125, and the input unit 126. The ASIC 15 supplies drive currents to the feeding motor 17, the conveying motor 18, and the carriage motor 19. The controller 10 drives the feeding motor 17, the conveying motor 18, and the carriage motor 19 to be rotated through pulse width modulation (PWM) control, for example.

The controller 10 also applies drive voltages to vibrating elements in the recording head 32 to eject ink droplets through the nozzles 33. Since the ASIC 15 is also connected to the registration sensor 120, the rotary encoder 121, and the second sheet sensor 123, the controller 10 can detect states of the printing device 1 based on signals outputted from the registration sensor 120, the rotary encoder 121, and the second sheet sensor 123.

Specifically, the controller 10 detects whether sheets P or second sheets P2 have passed the contact position with the first conveying roller 60 based on the detection signal outputted from the registration sensor 120. The controller 10 also detects the rotated amount of the first conveying roller 60 based on pulse signals outputted from the rotary encoder 121. The controller 10 estimates the conveyance amount of the sheet P along the first conveying passage R1 (equivalent to "L1" in FIG. 4) based on the pulse signals outputted from the rotary encoder 121 after the registration sensor 120 outputted an ON signal. The controller 10 also detects whether a second sheet P2 is present on the second conveying passage R2 based on the detection signal outputted from the second sheet sensor 123.

A USB memory or a USB cable can be connected to the USB interface 110. When a USB memory is connected to the USB interface 110, the controller 10 receives image data stored in the USB memory via the USB interface 110. When a USB cable is connected to the USB interface 110, the USB interface 110 receives a print job from a PC (personal computer) connected to the other end of the USB cable.

When a LAN cable is connected to the LAN interface 111, the controller 10 can receive a print command from a PC connected to the LAN interface 111. Note that, although the USB interface 110 and the LAN interface 111 are used as examples in the present embodiment, print jobs may also be received through wireless communication. Upon receiving a print job via the USB interface 110 or the LAN interface 111, the controller 10 controls the components in the printing device 1 to record an image corresponding to the print command included in the print job on sheets P.

<Process Executed when Printing Operation is Performed>

Next, steps for controlling a printing process on the printing device 1 according to the embodiment will be described with reference to the flowcharts in FIGS. 5 through 8. FIGS. 5 through 8 are flowcharts illustrating steps in the printing control process for the printing device 1.

Figure 5:
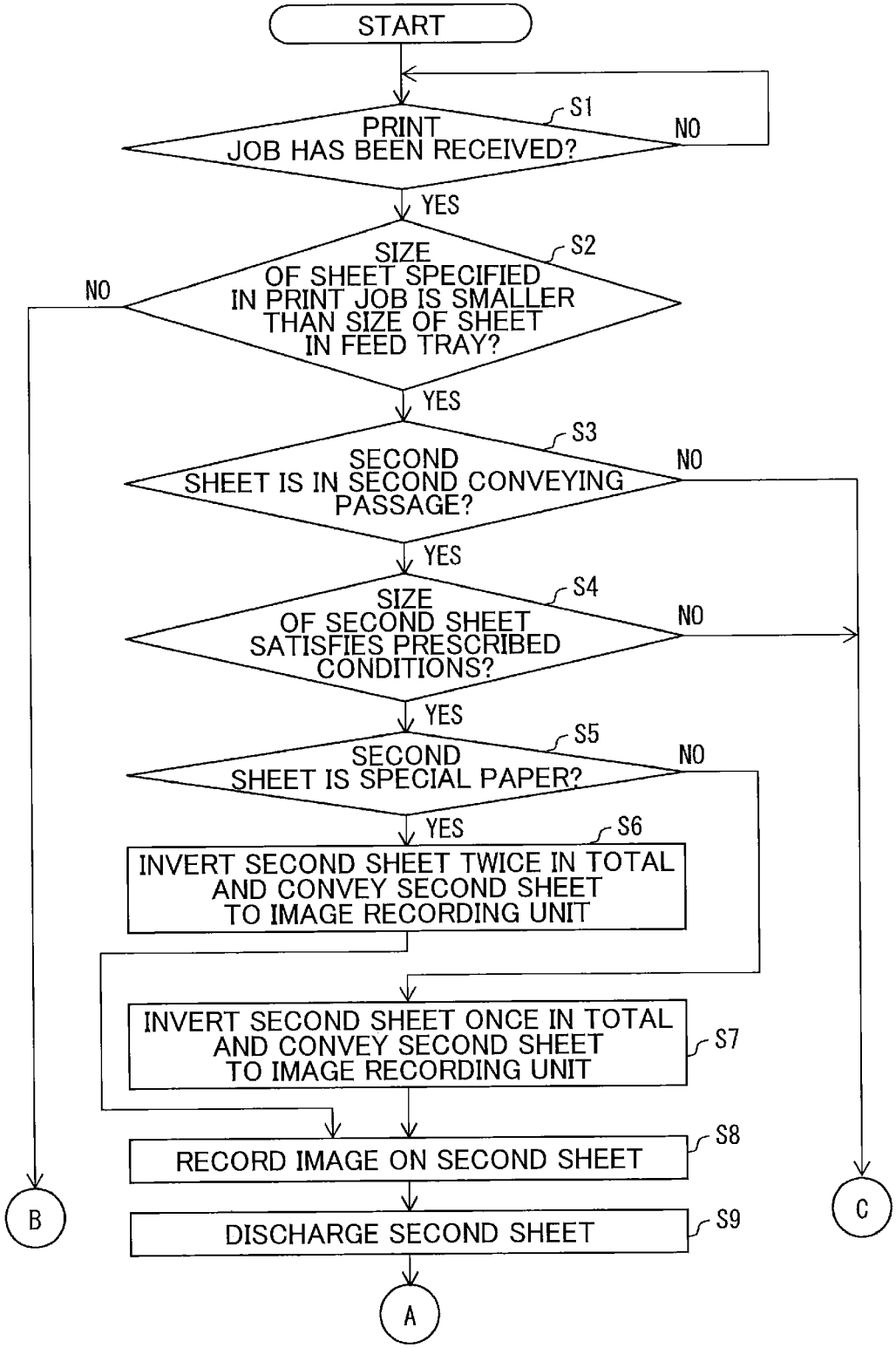
FIG. 5 is a flowchart illustrating steps in a printing process executed by a CPU in the printing device according to the embodiment.

In S1 of the flowchart in FIG. 5, the controller 10 first determines whether a print job has been received via the USB interface 110 or the LAN interface 111. The print job includes printing conditions such as the size and type of sheets P on which an image is to be printed, the number of pages to print, and whether color printing or monochromatic printing is to be performed. The controller 10 continues determination in S1 when a print job has not been received (S1: NO). When the controller 10 determines that a print job has been received (S1: YES), in S2 the controller 10 determines whether the size of the sheet P specified in the print job is smaller than the size of sheets P in the feeding tray 21.

When the controller 10 determines that the size of sheets P specified in the print job are the same size as the sheets P accommodated in the feeding tray 21 (S2: NO), the controller 10 advances to the process in S51 in the flowchart of FIG. 8. On the other hand, when the controller 10 determines that the size of sheets P specified in the print job (A5 size, for example) is smaller than the size of sheets P in the feeding tray 21 (A4 size, for example; S2: YES), in S3 the controller 10 determines whether a second sheet P2 is at a prescribed position in the second conveying passage R2 based on output from the second sheet sensor 123.

Here, a state in which the second sheet P2 is "at a prescribed position" denotes a state in which the second sheet P2 has been stopped in the second conveying passage R2 with the leading edge of the second sheet P2 in the second conveying direction D2 positioned upstream of the merging position X in the second conveying direction D2 and the trailing edge of the second sheet P2 in the second conveying direction D2 positioned downstream of the branching position Y in the second conveying direction D2.

Here, the second sheet sensor 123 is disposed at a position for detecting a second sheet P2 when the leading edge and the trailing edge of the second sheet P2 are positioned within a range described above. Based on the length of the second sheet P2 in the conveying direction and detection results from the registration sensor 120 and the rotary encoder 121, the controller 10 controls the conveyance amount for the second sheet P2 in the second conveying passage R2 so that the second sheet P2 is conveyed and halted at the prescribed position.

Note that, although the controller 10 halts the second sheet P2 at the prescribed position in the second conveying passage R2 based on output from the registration sensor 120 disposed along the first conveying passage R1 and the rotary encoder 121 in the present embodiment, a sensor disposed along the second conveying passage R2 (for example, the second sheet sensor 123) and the rotary encoder 121 may be employed to halt the second sheet P2 at the prescribed position in the second conveying passage R2.

When the controller 10 determines that a second sheet P2 is not in the second conveying passage R2 (S3: NO), the controller 10 advances to the process of S12 in FIG. 6. However, when the controller 10 determines that a second sheet P2 is in the second conveying passage R2 (S3: YES), in S4 the controller 10 determines whether the size of the second sheet P2 satisfies prescribed conditions. The prescribed conditions are: (1) the size of the second sheet P2 stored in the RAM 13 is greater than or equal to the size of the print data specified in the print job; (2) the size of the second sheet P2 is greater than or equal to a prescribed length, and the like. The prescribed length is the largest length in the conveying direction between any two neighboring rollers among the first conveying rollers 60 and 62, the reversing roller 64, and the discharging roller 66.

When the controller 10 determines that the second sheet P2 does not satisfy the prescribed conditions (S4: NO), the controller 10 advances to the process of S12 of FIG. 6. On the other hand, when the controller 10 determines that the second sheet P2 satisfies the prescribed conditions (S4: YES), in S5 the controller 10 determines whether the paper type of the second sheet P2 stored in the RAM 13 is a special paper. A "special paper" is a paper in which a front surface (one surface) and a back surface (another surface) thereof have characteristics different from each other, such as paper with a glossy front surface and a nonglossy back surface.

When the controller 10 determines that the paper type of the second sheet P2 is a special paper (S5: YES), in S6 the controller 10 conveys the second sheet P2 to the image recording unit 3 after the second sheet P2 has been inverted twice in total. That is, when the second sheet P2 in the first conveying passage R1 is conveyed onto the second conveying passage R2 through the branching position Y by the reversing roller 64 making reverse rotation, the second sheet P2 is inverted.

Since the second sheet P2 has already been inverted once relative to an original state when the second sheet P2 is in the second conveying passage R2 (when determination is made in the process of S3), the controller 10 executes the above operation second time, and conveys the second sheet P2 which has been inverted twice in total to the image recording unit 3. Accordingly, the above operation for inverting the second sheet P2 is performed twice in total allow the second sheet P2 to pass through the second conveying passage R2 twice in total.

In S8 the controller 10 controls the image recording unit 3 to record an image on the second sheet P2. Since the second sheet P2 has been flipped twice in total, the controller 10 can record an image on the glossy surface of the second sheet P2 at this time.

On the other hand, when the controller 10 determines in S5 that the paper type of the second sheet P2 is not a special paper (S5: NO), in S7 the controller 10 conveys the second sheet P2 to the image recording unit 3 after the second sheet P2 has been inverted once in total. Since the second sheet P2 has already been inverted once when the second sheet P2 is in the second conveying passage R2 as described above, in S7 the controller 10 conveys the second sheet P2 to the image recording unit 3 and advances to the process in S8 to record an image on the second sheet P2 according to the print job.

In this case, since the paper type of the second sheet P2 is not a special paper, an image may be recorded on the back surface of the second sheet P2. After completing the process in S8, in S9 the controller 10 discharges the second sheet P2 onto the discharging tray 22 and subsequently advances to the process in S11 in the flowchart of FIG. 6.

Figure 6:
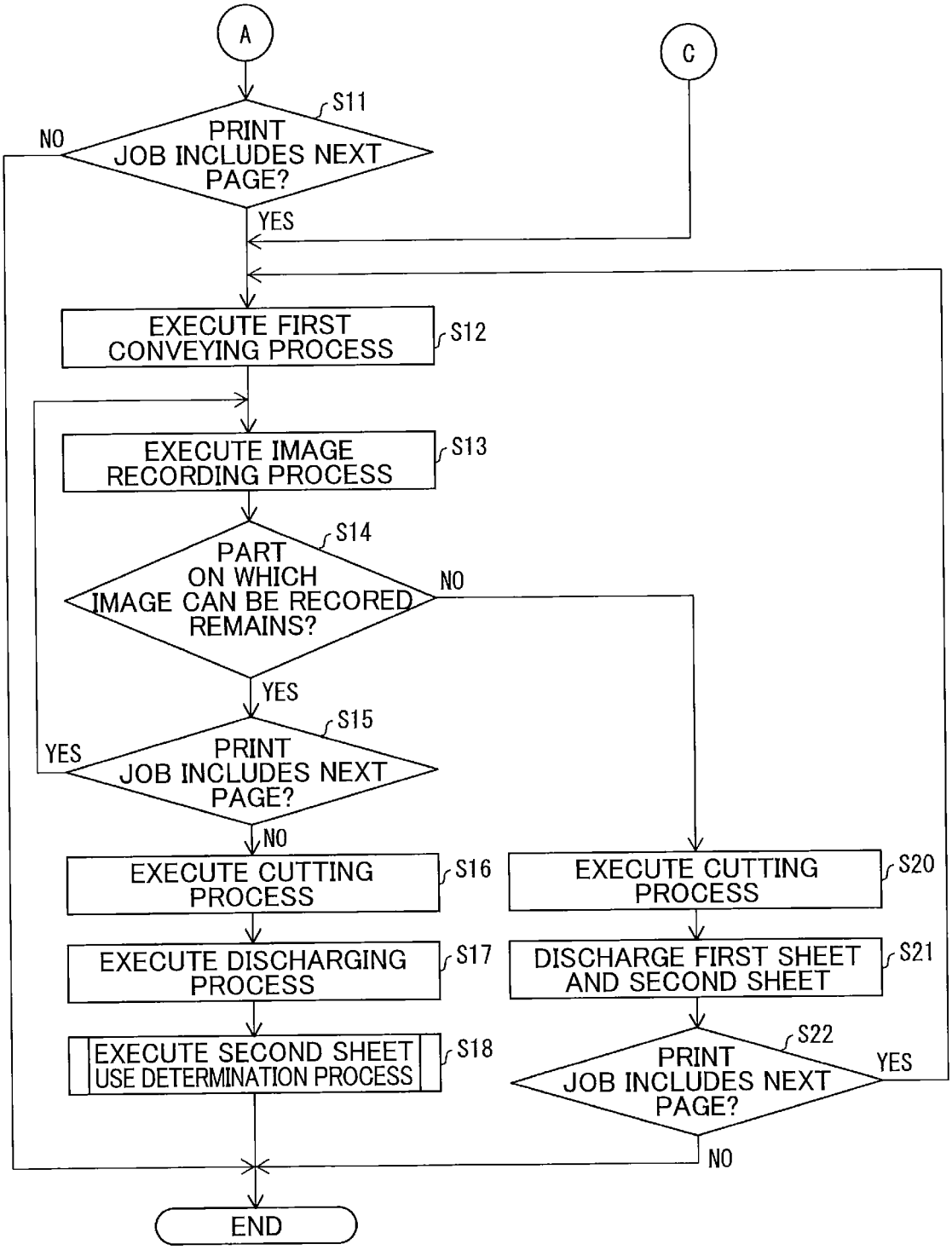
FIG. 6 is a flowchart illustrating steps subsequent to the steps in FIG. 5.

In S11 of the flowchart in FIG. 6, the controller 10 determines whether the print job includes a next page. When the controller 10 determines that a next page does not exist (S11: NO), the controller 10 ends the process of FIG. 6. However, when the controller 10 determines that a next page exists (S11: YES), in S12 the controller 10 performs a first conveying process. In the first conveying process, the controller 10 drives the feeding motor 17 to cause the feeding roller 23 to make forward rotation and to convey a sheet P fed from the feeding tray 21 to the image recording unit 3.

Specifically, when a leading edge of the sheet P contacts the second flap 48, the second flap 48 maintained in the first state by its own weight (depicted by the solid line in FIG. 2) is pivotally moved to the second state (depicted by a dashed line in FIG. 2) when pushed by a sheet P. Consequently, the second flap 48 guides the sheet P being conveyed in the first conveying direction D1 downstream of the merging position X along the guide member 41. When a trailing edge of the sheet P passes the second flap 48, the second flap 48 is pivotally moved back to the first state by its own weight.

When the leading edge of the sheet P reaches the first conveying roller 60, the controller 10 drives the conveying motor 18 to rotate the first conveying rollers 60 and 62, the reversing roller 64, and the discharging roller 66 and conveys the sheet P until the leading edge of the sheet P reaches the image recording unit 3. In S13 the controller 10 executes an image recording process using the image recording unit 3 to record an image on the sheet P conveyed to the image recording unit 3.

More specifically, in the image recording process of S13, the controller 10 repeats alternately the line feed process and a recording process described next. In the line feed process, the controller 10 drives the first conveying rollers 60 and 62, the reversing roller 64, and the discharging roller 66 through forward rotation of the conveying motor 18 in order to convey the sheet P a prescribed conveyance amount in the first conveying direction D1. In the recording process, the controller 10 drives the carriage motor 19 to move the carriage 31 in the width direction of the sheet P while conveyance of the sheet P is halted, and records an image for one line by ejecting ink droplets onto the sheet P through nozzles 33 in the recording head 32.

While the image recording unit 3 is recording an image on the sheet P and after image recording is complete, the first conveying rollers 60 and 62 convey the sheet P along the first conveying passage R1 in the first conveying direction D1. As the leading edge of the sheet P contacts an upper surface of the first flap 46, the first flap 46 is pivotally moved in a direction away from the guide member 43 into the second state (the state indicated by a dashed line in FIG. 2).

Subsequently, the reversing roller 64 rotating forward continues to convey the first sheet P1 in the first conveying direction D1. Once the trailing edge of the sheet P passes the first flap 46, the first flap 46 is pivotally moved back from the second state to the first state owing to the urging force of the coil spring 47.

After completing the image recording process in S13, i.e., once an image for one page has been recorded on the sheet P, in S14 the controller 10 determines whether a part on which an image can be recorded remains in the sheet P. Specifically, when an image of the first page in the current print job has been recorded on the sheet P (S3: NO, S4: NO), the controller 10 determines that a part on which an image can be recorded remains in the sheet P (S14: YES) when an image of an odd-number page in the print job has been recorded on the sheet P in S13. However, when an image of the first page in the print job has been recorded on the second sheet P2 (S8), the controller 10 determines that a part on which an image can be recorded remains in the sheet P (S14: YES) when an image of an even-number page in the print job has been recorded on the sheet P in S13.

When the controller 10 determines that there remains a part on which an image can be recorded in the sheet P (S14: YES), in S15 the controller 10 determines whether there remains another page to be printed. When the controller 10 determines that a next page exists (S15: YES), the controller 10 returns to the process in S13 without cutting the sheet P, and performs an image recording process for the next page. Note that the cutting process may be performed while recording an image on the next page, depending on the cutting position.

When the controller 10 determines that a next page does not exist (S15: NO), in S16 the controller 10 performs a cutting process for cutting the sheet P by conveying the sheet P until the cutting position of the sheet P reaches the cutting unit 100 and controlling the cutting unit 100 to cut the sheet P. In the example of FIG. 4, the cutting unit 100 cuts the sheet P to divide the sheet P into a first sheet P1 and a second sheet P2 that are one half the size of the sheet P.

Cutting the sheet P after image recording in this way produces the first sheet P1 having an image recorded thereon and the second sheet P2 having no image recorded thereon. Accordingly, the blank second sheet P2 can be reused. Note that, although the sheet P is cut in half in the example of FIG. 4, the cutting position for the sheet P may be adjusted according to the sheet size in the print data. For example, the first sheet P1 cut from the sheet P may be one-third the size of the original sheet P.

After completing the cutting process of S16, in S17 the controller 10 performs a discharging process. In this process, the controller 10 controls the conveying motor 18 to rotate the first conveying rollers 60 and 62, the reversing roller 64, and the discharging roller 66 forward in order to convey the first sheet P1 in the first conveying direction D1 and to discharge the first sheet P1 into the discharging tray 22 (to an outside of the printing device 1). At this time, the second sheet P2 is also conveyed in the first conveying passage R1 following the first sheet P1.

After a trailing edge of the first sheet P1 passes the position of the discharging roller 66, i.e., after the first sheet P1 has been discharged, the controller 10 continues rotating the conveying motor 18 forward until a trailing edge of the second sheet P2 in the first conveying passage R1 passes the position of the first flap 46. Once the trailing edge of the second sheet P2 in the first conveying passage R1 has passed the position of the first flap 46, the controller 10 performs a second sheet use determination process in S18 (described later).

On the other hand, when the controller 10 determines that there are no part on which an image can be recorded on the sheet P, i.e., the image recording unit 3 has recorded images on all parts in the sheet S, then two pages worth of images have been recorded on the sheet P, in S20 the controller 10 performs a cutting process to convey the cutting position of the sheet P to the cutting unit 100 for cutting the sheet P. The determination in S14 is performed just after image recording is completed for the last line of the image.

After completing the cutting process of S20, in S21 the controller 10 performs a discharging process. In this process, the controller 10 controls the conveying motor 18 to cause the first conveying rollers 60 and 62, the reversing roller 64, and the discharging roller 66 to make forward rotation, thereby conveying the first sheet P1 and the second sheet P2 in the first conveying direction D1 and discharging both onto the discharging tray 22.

After completing the discharging process of S21, in S22 the controller 10 determines whether other pages remain in the print job. When a next page exists (S22: YES), the controller 10 returns to the process in S12. When a next page does not exist (S22: NO), the controller 10 ends the process of FIG. 6.

Figure 7:
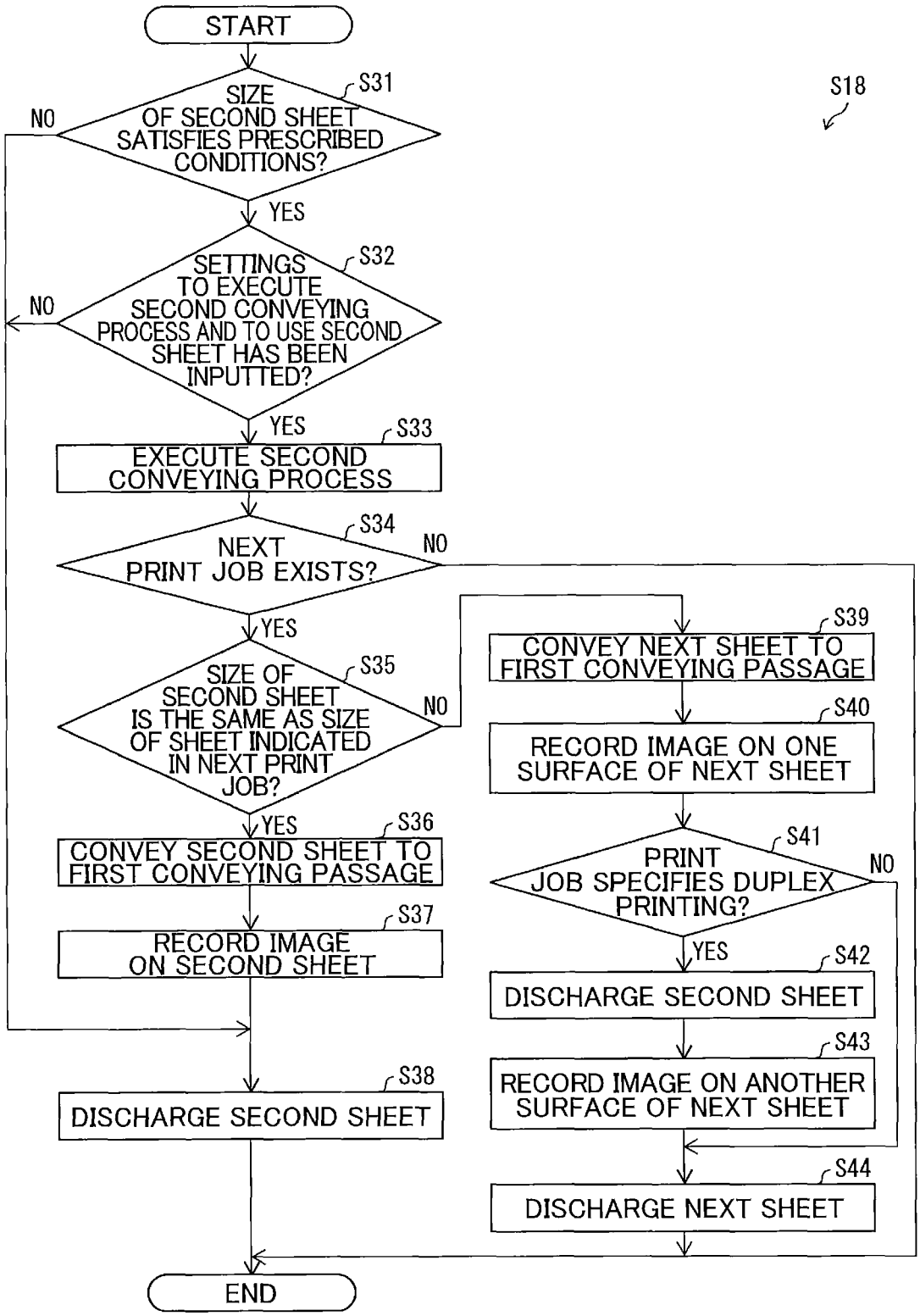
FIG. 7 is a flowchart illustrating step in a second sheet use determination process in FIG. 6 executed by the CPU in the printing device according to the embodiment.

Next, the second sheet use determination process of S18 will be described with reference to FIG. 7. The second sheet use determination process is executed to determine whether to use a second sheet P2 generated by cutting a sheet P in the process of S16 in a subsequent printing process. In S31 of the flowchart in FIG. 7, the controller 10 first detects the size of the second sheet P2 and determines whether the size meets the prescribed conditions.

Here, an example method for detecting the size of the second sheet P2 will be described. The size of a second sheet P2 is defined by a length L2 in the conveying direction and a width W2 in the width direction, as illustrated in FIG. 4. The length L2 of the second sheet P2 is found by subtracting the length L1 of the first sheet P1 from the total length L of the sheet P (L2=L−L1), while the width W2 of the second sheet P2 is equivalent to the width W of the sheet P (W2=W). The width W2 of the second sheet P2 may also be detected by an optical sensor provided on the carriage 31, such as a media sensor.

Here, the length L and the width W of the sheet P are defined by standard sizes. The length of the first sheet P1 is determined by the size of print data specified in the print job. For example, if the size of the sheet is the A4 size, then L=297 mm and W=210 mm. The length L of the sheet P may also be found based on pulse signals outputted from the rotary encoder 121 from the timing that the registration sensor 120 detects the leading edge of the sheet P to the timing that the registration sensor 120 detects the trailing edge of the sheet P.

When the size of print data specified in the print job is A5, the conveyance amount is adjusted so that the cutting position is set to the position equivalent to the length of the short side of an A5 sheet. That is, the conveyance amount of the sheet P is equivalent to the length L1 of the first sheet P1. The size of the second sheet P2 in the conveying direction is set based on the conveyance amount (the length L1) to the cutting position and the length L of the sheet P in the conveying direction. In this way, the registration sensor 120 and the rotary encoder 121 fulfill the function of a paper sensor that detects the size of the second sheet P2.

The prescribed conditions in the example given above are: (1) the size of the second sheet P2 is greater than or equal to the size of the print data specified in the print job; and (2) the length L2 of the second sheet P2 in the conveying direction (see FIG. 4) is greater than or equal to the largest distance between any two neighboring rollers from among the rollers 60, 62, 64, and 66.

When the controller 10 determines in S31 that the second sheet P2 satisfies the prescribed conditions (S31: YES), in S32 the controller 10 determines whether the user, through operations on the operating unit 125, has inputted a setting (1) to execute a second conveying process and a setting (2) to use the second sheet P2.

When the controller 10 determines in S32 that the user has not inputted both settings (1) and (2) (S32: NO), or when the controller 10 determines that the second sheet P2 does not satisfy the prescribed conditions (S31: NO), in S38 the controller 10 discharges the second sheet P2 onto the discharging tray 22 and subsequently ends the second sheet use determination process of FIG. 7.

On the other hand, when the controller 10 determines in the S32 that the user has inputted the both settings (1) and (2) (S32: YES), in S33 the controller 10 executes the second conveying process to convey the second sheet P2 onto the second conveying passage R2. At the time when the determination is made in S31, the size and paper type (normal paper, glossy paper, etc.) for the second sheet P2 are stored in the RAM 13.

Specifically, in S33 the controller 10 drives the conveying motor 18 in reverse to cause the reversing roller 64 to make reverse rotation. Consequently, the reversing roller 64 conveys the second sheet P2 along the first conveying passage R1 in a direction opposite the first conveying direction D1. At this time, the first flap 46 is maintained in the first state owing to the urging force of the coil spring 47. That is, after the first sheet P1 has been cut and the trailing edge of the second sheet P2 has been conveyed past the first flap 46, the first flap 46 is urged by the coil spring 47 into a state for closing the first conveying passage R1.

Therefore, the second sheet P2 being conveyed in the reverse direction along the first conveying passage R1 is guided along the bottom surface of the first flap 46 into the second conveying passage R2. The controller 10 continues driving the conveying motor 18 to rotate the second conveying roller 68 to convey the second sheet P2 along the second conveying passage R2 in the second conveying direction D2.

After completing the second conveying process of S33, in S34 the controller 10 determines whether a next print job exists. When determining that a next print job exists (S34: YES), in S35 the controller 10 determines whether the size of the second sheet P2 is the same size indicated in the print data for the next print job.

On the other hand, when the controller 10 determines that a next print job does not exist (S34: NO), the controller 10 halts the second sheet P2 at the prescribed position in the second conveying passage R2 (see FIG. 2) so that the leading edge of the second sheet P2 in the second conveying direction D2 is positioned upstream of the merging position X in the second conveying direction D2 and that the trailing edge of the second sheet P2 in the second conveying direction D2 is positioned downstream of the branching position Y in the second conveying direction D2. Subsequently, the controller 10 ends the process of FIG. 7.

When the controller 10 determines in S35 that the size of the second sheet P2 is the same as the size indicated in the print data for the next print job (S35: YES), in S36 the controller 10 conveys the second sheet P2 onto the first conveying passage R1 without halting the second sheet P2 at the prescribed position in the second conveying passage R2. Here, the controller 10 conveys the second sheet P2 from the second conveying passage R2 to the image recording unit 3 by controlling the feeding motor 17 to maintain the feeding roller 23 in a halted state and by controlling the conveying motor 18 to rotate the second conveying roller 68 and the first conveying roller 60.

In S37 the controller 10 controls the image recording unit 3 to record next image on the second sheet P2, and in S38 discharges the second sheet P2 into the discharging tray 22, and subsequently ends the process of FIG. 7.

On the other hand, when the controller 10 determines that the size of the second sheet P2 is different from the size indicated in the print data for the next print job (S35: NO), the controller 10 halts the second sheet P2 at the prescribed position in the second conveying passage R2 and in S39 conveys the next sheet P from the feeding tray 21 onto the first conveying passage R1. In S40 the controller 10 controls the image recording unit 3 to record an image on one surface of the next sheet P.

In S41 the controller 10 determines whether the print job specifies duplex printing. When the controller 10 determines that duplex printing is not specified in the print job (S41: NO), in S44 the controller 10 discharges the sheet P on which image has been just recorded in S40 onto the discharging tray 22.

On the other hand, when the controller 10 determines that duplex printing is specified in the print job (S41: YES), in S42 the controller 10 conveys the sheet P just recorded in S40 into the second conveying passage R2 while conveying the second sheet P2 previously halted in the second conveying passage R2 onto the first conveying passage R1.

The controller 10 further conveys the second sheet P2 and the sheet P trailing the second sheet P2, discharging the second sheet P2 into the discharging tray 22 and inverting the trailing sheet P in the process. After the trailing sheet P has been inverted, in S43 the controller 10 conveys the sheet P to the image recording unit 3 and records an image on a back surface of the sheet P. Subsequently in S44 the controller 10 discharges the sheet P into the discharging tray 22 and ends the process of FIG. 7.

Figure 8:
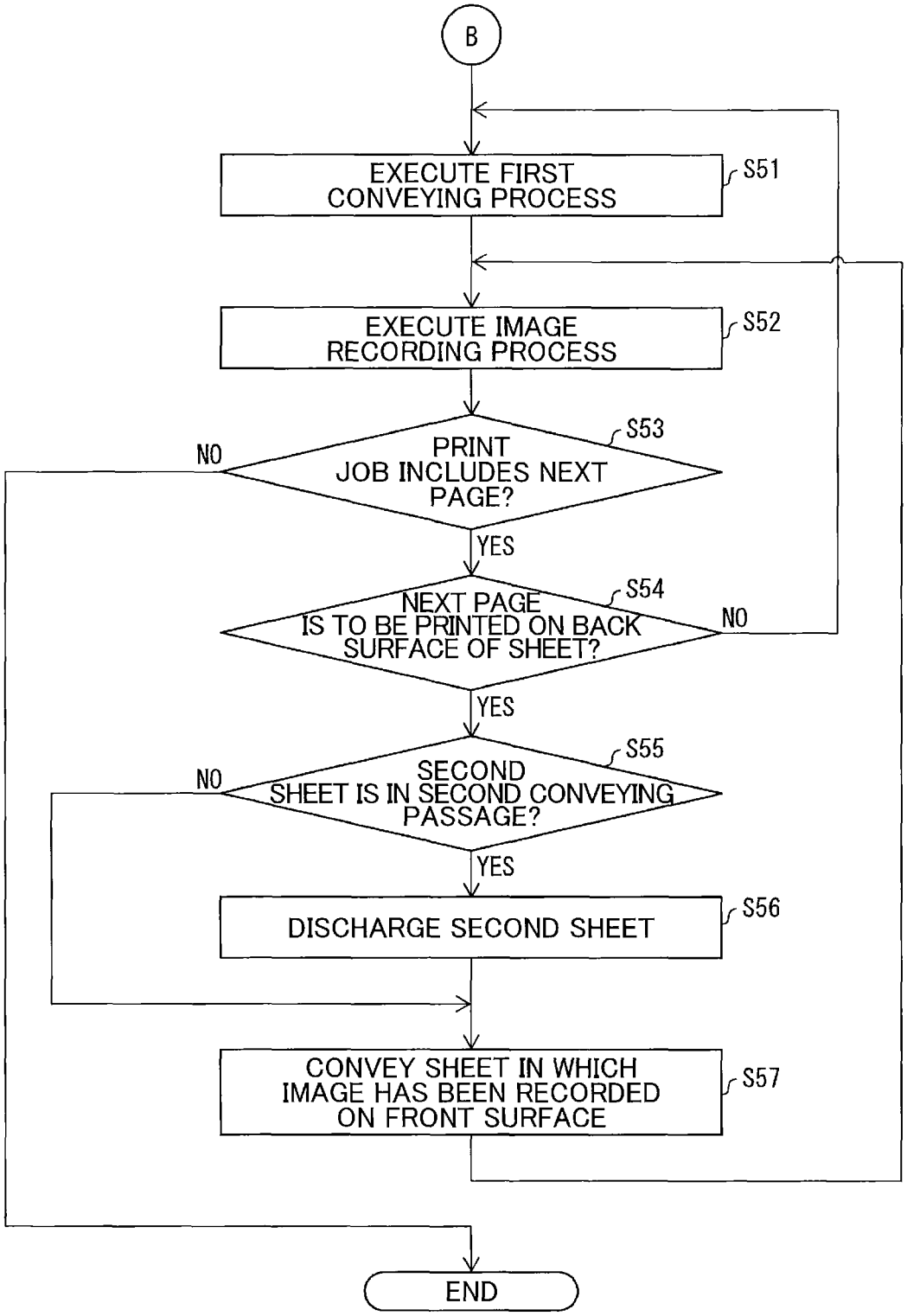
FIG. 8 is a flowchart illustrating steps subsequent to the steps in FIG. 5.

Next, the flowchart in FIG. 8 will be described. The controller 10 executes the process in FIG. 8 when determining in S2 of FIG. 5 that the size of the sheet P specified in the print job is the same as the size of sheets P in the feeding tray 21 (S2: NO). In S51 at the beginning of the flowchart in FIG. 8, the controller 10 executes the first conveying process to convey a sheet P from the feeding tray 21 to the image recording unit 3. In S52 the controller 10 executes the image recording process to record an image on the sheet P conveyed to the image recording unit 3.

In S53 the controller 10 determines whether next page(s) exists in the print job. When the controller 10 determines that a next page exists (S53: YES), in S54 the controller 10 determines whether the next page is to be printed on a back surface of the sheet S in a duplex printing.

When the controller 10 determines that the next page is not the back surface of a duplex printing (S54: NO), the controller 10 discharges the sheet P on which the image has been just recorded, and returns to S51 to feed, convey, and record an image on the next sheet P. On the other hand, when determining that the next page is to be printed on the back surface in a duplex printing (S54: YES), in S55 the controller 10 determines whether a second sheet P2 is in the second conveying passage R2 based on output from the second sheet sensor 123.

When the controller 10 determines that a second sheet P2 is in the second conveying passage R2 (S55: YES), in S56 the controller 10 discharges the second sheet P2 onto the discharging tray 22. On the other hand, when the controller 10 determines that a second sheet P2 is not in the second conveying passage R2 (S55: NO) or after completing the discharging process of S56, in S57 the controller 10 conveys the sheet P just recorded on its front surface through the second conveying passage R2 to the image recording unit 3 while the sheet P is inverted. Subsequently, the controller 10 returns to the process in S52. When the controller 10 determines in S53 that a next page does not exist (S53: NO), the controller 10 ends the process of FIG. 8.

<Control Process when Power is Turned Off>

Figure 9:
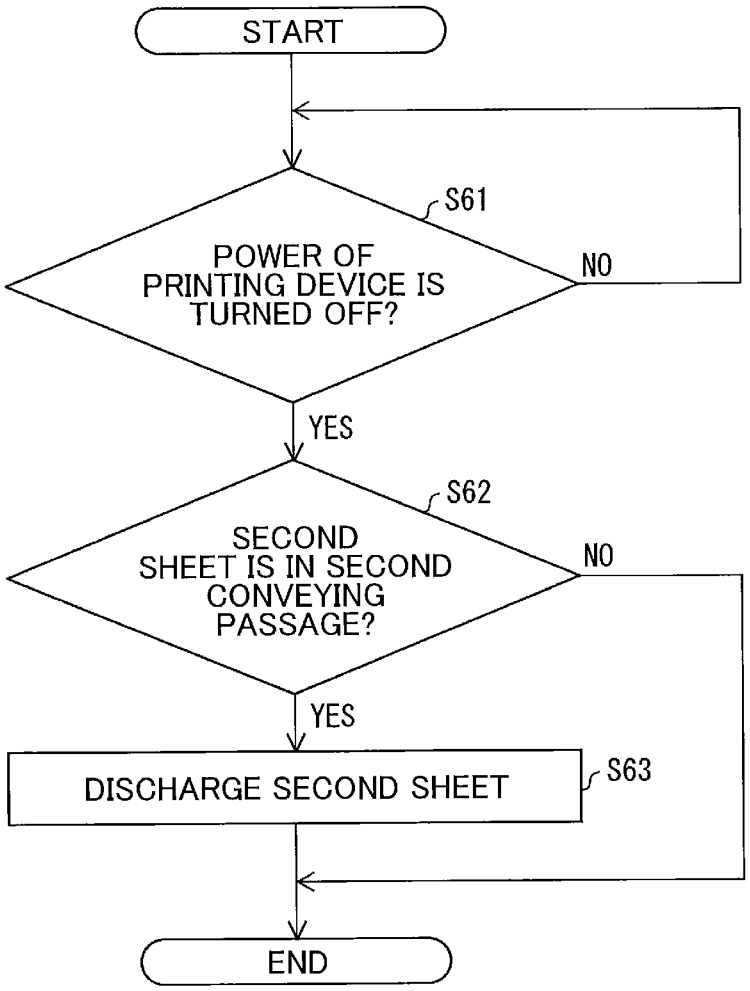
FIG. 9 is a flowchart illustrating steps executed when power to the printing device is turned off by the CPU in the printing device according to the embodiment.

Next, the control process performed when the power of the printing device 1 in the embodiment is turned off will be described with reference to the flowchart in FIG. 9. FIG. 9 illustrates steps in the control process performed when the power to the printing device 1 is turned off. In S61 at the beginning of FIG. 9, the controller 10 determines whether the power has been turned off.

While the controller 10 determines that the power has not been turned off (S61: NO), the controller 10 continually repeats the determination in S61 at prescribed intervals. When the user performs an operation to turn off the power (S61: YES), in S62 the controller 10 determines, based on output from the second sheet sensor 123, whether the second sheet P2 is present on the second conveying passage R2.

When the controller 10 determines that a second sheet P2 is in the second conveying passage R2 (S62: YES), in S63 the controller 10 controls the conveying motor 18 to rotate the second conveying roller 68 in order to convey the second sheet P2 onto the first conveying passage R1 and further controls the conveying motor 18 to cause the first conveying rollers 60 and 62, the reversing roller 64, and the discharging roller 66 to make forward rotation to thereby discharge the second sheet P2 onto the discharging tray 22. On the other hand, when the controller 10 determines that a second sheet P2 is not in the second conveying passage R2 (S62: NO) or after completing the discharging process of S63, the controller 10 ends the process of FIG. 9.

Effects of the Embodiment

With the printing device 1 according to the embodiment described above, the image recording unit 3 records an image of a smaller size (A5 size, for example) than the size of sheets P loaded in the printing device 1 (A4 size, for example) (S13). Subsequently, the cutting unit 100 cuts the sheet P (S16) to form a first sheet P1 on which an image has been recorded and a blank second sheet P2. The printing device 1 discharges the first sheet P1 onto the discharging tray 22 (S17) and conveys the second sheet P2 onto the second conveying passage R2 (S33).

In this way, the second sheet P2 resulting from cutting the sheet P is kept in the second conveying passage R2 and can be used immediately in the next printing operation. Since the cut second sheet P2 can be used without being returned to the feeding tray 21, this process can prevent the cut second sheet P2 from becoming entangled with the feeding roller 23 or the like and causing a paper jam, for example. Thus, the blank sheet remaining from a cut sheet P can be used effectively.

When the controller 10 conveys the second sheet P2 into the second conveying passage R2, the controller 10 switches the leading edge and the trailing edge of the second sheet P2 to each other. Specifically, at this time, the trailing edge of the second sheet P2 that follows the leading edge of the second sheet P2 when the second sheet P2 is conveyed in the first conveying passage R1 in the first conveying direction D1 becomes the leading edge that precedes the trailing edge of the second sheet P2 when the second sheet P2 is in the second conveying passage R2 in the second conveying direction D2.

Accordingly, the controller 10 conveys the second sheet P2 to the image recording unit 3 in an inverted state relative to a state prior to the second sheet P2 passing through the second conveying passage R2, i.e., an original state in which the sheet P is conveyed to the image recording unit 3 in the process of S12 (S7, S33). When the sheet P is conveyed in the first conveying passage R1 in its original state in S12, the front surface (one surface) of the sheet P faces the image recording unit 3. When the second sheet P is conveyed in the first conveying passage R1 in the inverted state in the process of S36, the back surface of the second sheet P, which is a part of the back surface (another surface) of the sheet P opposite the front surface, faces the image recording unit 3.

Since this configuration flips the front-back surfaces of the second sheet P2 when the second sheet P2 passes through the second conveying passage R2, it is possible to execute duplex printing on the second sheet P2 by inverting the second sheet P2 twice in total, for example.

Additionally, the controller 10 halts the second sheet P2 at a prescribed position in the second conveying passage R2 such that the leading edge of the second sheet P2 in the second conveying direction D2 is positioned upstream of the merging position X in the second conveying direction D2 and the trailing edge of the second sheet P2 in the second conveying direction D2 is positioned downstream of the branching position Y in the second conveying direction D2. By halting the cut second sheet P2 at a prescribed position in the second conveying passage R2, the cut second sheet P2 can be prevented from interfering with conveyance of the next sheet P supplied from the feeding tray 21 onto the first conveying passage R1.

In particular, by using the detection results of the registration sensor 120 that detects the leading edge and the trailing edge of the sheet P and the detection results of the rotary encoder 121 that detects the conveyance amount of the second sheet P2, the controller 10 can accurately halt the second sheet P2 at the prescribed position in the second conveying passage R2. Thus, the controller 10 can reliably prevent the second sheet P2 from being halted while a portion of the second sheet P2 remains in the first conveying passage R1.

Further, when the second sheet P2 is to be conveyed into the first conveying passage R1, the controller 10 can convey the second sheet P2 from the second conveying passage R2 to the image recording unit 3 by rotating the second conveying roller 68 and the first conveying roller 60 while the feeding roller 23 remains halted (S36). Accordingly, the controller 10 can prevent such problems as the second sheet P2 being conveyed while overlapping the successive sheet P since the next sheet P is not supplied from the feeding tray 21 onto the first conveying passage R1 in this case. Thus, the cut second sheet P2 can be used effectively.

The controller 10 also receives the width W of the sheet P via the input unit 126 and determines the length L2 from the leading edge to the trailing edge of the second sheet P2 based on the detection results from the registration sensor 120, and stores these values for the size of the second sheet P2 in the RAM 13. Accordingly, this configuration enables the controller 10 to store the size of the second sheet P2 conveyed into the second conveying passage R2 in the RAM 13 so that the controller 10 can accurately determine whether the second sheet P2 can be used in the next printing operation.

Further, in the second sheet use determination process, the controller 10 conveys the second sheet P2 into the second conveying passage R2 in a second conveying process when the size of the second sheet P2 stored in the RAM 13 satisfies the prescribed conditions and discharges the second sheet P2 to an outside of the printing device 1 when the size does not meet the prescribed conditions. In this way, when the size of the second sheet P2 does not satisfy the prescribed conditions, the controller 10 can prevent the occurrence of paper jams or other problems by simply discharging the second sheet P2 from the printing device 1 without conveying the second sheet P2 onto the second conveying passage R2.

When the size of the second sheet P2 stored in the RAM 13 is the same size as indicated in print data for the next print job (S35: YES), the controller 10 conveys the second sheet P2 onto the first conveying passage R1 rather than halting the second sheet P2 in the second conveying passage R2, enabling the second sheet P2 to be used immediately in the next printing operation. This configuration can reduce printing time.

When the print command for the next print job indicates duplex printing (S41: YES) but the size of the second sheet P2 stored in the RAM 13 differs from the size of the print data in the next print job (S35: NO), the controller 10 conveys the next sheet P in the feeding tray 21 to the image recording unit 3 in the first conveying direction D1 (S39), records an image on one surface of the sheet P with the image recording unit 3 (S40), and subsequently discharges the second sheet P2 into the discharging tray 22 by rotating the second conveying roller 68, the first conveying rollers 60 and 62, the reversing roller 64, and the discharging roller 66 while the feeding roller 23 remains halted (S42).

In the meantime, the controller 10 conveys the just-printed sheet P through the second conveying passage R2 and back onto the first conveying passage R1 to record an image on another surface of the sheet P with the image recording unit 3 (S43).

With this configuration, if the size of the second sheet P2 differs from the size indicated by the print data for the next print job, the controller 10 can execute a print on one surface of the next sheet P and a print on the back surface of the next sheet P while discharging the second sheet P2. In this way, duplex printing for the next sheet P can be performed rapidly.

After recording an image on one surface of the next sheet P using the image recording unit 3, the controller 10 conveys the next sheet P in the first conveying direction D1 to a position not overlapping the trailing second sheet P2. With this configuration, the controller 10 can perform proper duplex printing on the next sheet P by conveying the next sheet P so that the sheet P does not overlap the trailing second sheet P2.

If the information related to the type of sheet P stored in the RAM 13 indicates a special paper having characteristics on one surface and another surface different from each other (S5: YES), the controller 10 conveys the second sheet P2 twice (an even number of times) in total through the second conveying passage R2, and after that, conveys the second sheet P2 to the image recording unit 3. In this way, if the paper type of the sheet P is a special paper such as a glossy paper, the controller 10 can reliably record an image on only the glossy surface side of the second sheet P2.

The controller 10 executes the second conveying process (S33) when settings has been received through the operating unit 125 for executing the second conveying process (S32: YES) and does not execute the second conveying process when settings has not been received (S32: NO). This enables the user to select whether to convey the second sheet P2 onto the second conveying passage R2.

The controller 10 conveys the second sheet P2 to the image recording unit 3 when settings has been received via the input unit 126 to use the second sheet P2 for printing in the subsequent print job (S32: YES) and does not convey the second sheet P2 to the image recording unit 3 when settings to use the second sheet P2 in a subsequent printing operation has not been received via the input unit 126 (S32: NO). In this way, the user can select whether to print using the second sheet P2 on the second conveying passage R2.

The printing device 1 is provided with the second sheet sensor 123 for detecting the presence or the absence of the second sheet P2 on the second conveying passage R2. Accordingly, the controller 10 can detect whether a second sheet P2 is present on the second conveying passage R2 using the second sheet sensor 123.

When the controller 10 detects through the second sheet sensor 123 that a second sheet P2 is not present on the second conveying passage R2 (S55: NO), the controller 10 does not convey the second sheet P2, thereby preventing an unnecessary conveying operation for the second sheet P2.

If the controller 10 detects through the second sheet sensor 123 that a second sheet P2 is present on the second conveying passage R2 when the power is turned off (S62: YES), the controller 10 discharges the second sheet P2 onto the discharging tray 22 (S63). By discharging a second sheet P2 present in the second conveying passage R2 into the discharging tray 22 when the power has been turned off, the controller 10 can prevent paper jams or the like from occurring by the second sheet P2 being bent or moved within the printing device 1 while the power is off.

In the image recording process (S13, S52), the controller 10 repeatedly alternates between the line feed process for conveying the sheet P by prescribed amounts in the first conveying direction D1, and the recording process for driving the carriage 31 and ejecting ink from the recording head 32 while the conveyance of the sheet P is halted. In this way, the sheet P is conveyed intermittently in the line feed process, enabling the sheet P to be easily halted in desired positions and allowing the sheet P to be cut with high precision.

Variations of the Embodiment

The embodiment describes a case in which the cutting unit 100 cuts the sheet P in half, as illustrated in FIG. 4. However, the cutting position on the sheet P may be adjusted according to the size of the print data. For example, one-third of the sheet P may be cut.

In the printing device 1 according to the above-described embodiment, roller members (the first conveying rollers 60 and 62, the reversing roller 64, the discharging roller 66, and the second conveying roller 68) are used to convey the sheets P, but the sheets P may also be conveyed by a belt member, a drum member, or the like.

In the printing device 1 according to the above-described embodiment, the second conveying passage R2 for returning a sheet P to the upstream side of the image recording unit 3 branches from the first conveying passage R1 on the downstream side of the image recording unit 3.

However, the second conveying passage R2 may be formed to branch from the first conveying passage R1 at a branching position upstream of the image recording unit 3 and may be further formed to merge with the first conveying passage R1 on the upstream side of the image recording unit 3 at a position either upstream or downstream of that branching position with respect to the conveying direction. Note that the merging position of the first conveying passage R1 and the second conveying passage R2 is spaced apart from the feeding tray 21.

In the second conveying process in the printing device 1 according to the above-described the embodiment, the printing device 1 halts the second sheet P2 at a position where neither the leading edge nor the trailing edge of the second sheet P2 protrudes into the first conveying passage R1. However, the second sheet P2 may be halted at a position where one of the leading edge and the trailing edge of the second sheet P2 does not protrude into the first conveying passage R1.

In this case, the second sheet P2 must be discharged from the printing device 1 prior to feeding the next sheet P for the next print job in a case where the second sheet P2 is not being used in the next print job, for example.

While the description has been made in detail with reference to the embodiments, it would be apparent to those skilled in the art that many modifications and variations may be made thereto.

REMARKS

The registration sensor 120 is an example of a sheet edge sensor. The second sheet sensor 123 is also an example of the sheet edge sensor. The rotary encoder 121 is an example of a conveyance amount sensor. The first conveying rollers 60 and 62, the reversing roller 64, and the discharging roller 66 are examples of a first conveying roller. The RAM 13 is an example of a storage. The process in S12 executed by the controller 10 is an example of (a) conveying. The process in S13 executed by the controller 10 is an example of (b) recording. The process in S16 executed by the controller 10 is an example of (c) cutting. The process in S17 executed by the controller 10 is an example of (d) discharging. The process in S33 executed by the controller 10 is an example of (e) conveying. The process in S36 executed by the controller 10 is an example of (f) conveying. The process in S36 executed by the controller is also an example of (g) conveying. The process executed by the controller 10 for storing information on a size and a type for the second sheet P2 in the RAM 13 is an example of (h) storing. The process in S38 executed by the controller 10 is an example of (i) discharging. The process in S37 executed by the controller 10 is an example of (j) recording. The process in S39 executed by the controller 10 is an example of (k) conveying. The process in S40 executed by the controller 10 is an example of (l) recording. The process in S42 executed by the controller 10 is an example of (m) discharging. The process in S42 executed by the controller 10 is also an example of (n) conveying. The process in S43 executed by the controller 10 is an example of (o) recording. The processes in S33 and S6 executed by the controller 10 are an example of (p) conveying. The process in S6 is an example of S6 executed by the controller 10 is also an example of (q) conveying. The process in S37 executed by the controller 10 is an example of (r) conveying. The process in S63 executed by the controller 10 is an example of (s) discharging. The line feed process executed by the controller 10 is an example of (b1) conveying. The recording process executed by the controller 10 is an example of (b2) ejecting.

What is claimed is:

1. A printing device comprising:

a feeding tray on which a sheet can be mounted;

a first conveying passage in which the sheet is conveyed in a first conveying direction;

an image recording unit disposed along the first conveying passage and configured to record an image on the sheet;

a cutting unit disposed along the first conveying passage at a position downstream of the image recording unit in the first conveying direction, the cutting unit being configured to cut the sheet;

a second conveying passage in which the sheet is conveyed in a second conveying direction different from the first conveying direction, the second conveying passage being connected to the first conveying passage at a merging position on the first conveying passage positioned upstream of the image recording unit in the first conveying direction; and a controller configured to perform:

(a) conveying the sheet mounted on the feeding tray to the image recording unit;

(b) recording, using the image recording unit, an image on the sheet;

(c) cutting, using the cutting unit, the sheet on which the image has been recorded in the (b) recording at a cutting position on the sheet to divide the sheet into a first sheet on which the image has been recorded and a second sheet on which the image has not been recorded;

(d) discharging the first sheet to an outside; and (e) conveying the second sheet to the second conveying passage.

2. The printing device according to claim 1, wherein the second conveying passage branches from the first conveying passage at a branching position on the first conveying passage, wherein, in the (e) conveying, the controller is configured to convey the second sheet in the first conveying passage to the second conveying passage while switching a leading edge and a trailing edge of the second sheet to each other such that a trailing edge of the second sheet following a leading edge of the second sheet when the second sheet is conveyed in the first conveying passage in the first conveying direction becomes a leading edge of the second sheet preceding a trailing edge of the second sheet when the second sheet is in the second conveying passage in the second conveying direction, and wherein the controller is configured to further perform:

(f) conveying, after performing the (e) conveying, the second sheet to the image recording unit while the second sheet is in an inverted state relative to an original state of the sheet when the (a) conveying is performed, the sheet in the original state being conveyed in the first conveying passage in the (a) conveying such that one surface of the sheet faces the image recording unit, the second sheet in the inverted state being conveyed in the first conveying passage in the (f) conveying such that one surface of the second sheet faces the image recording unit, the one surface of the second sheet being a part of another surface of the sheet opposite the one surface of the sheet.

3. The printing device according to claim 1, wherein the second conveying passage branches from the first conveying passage at a branching position on the first conveying passage, and wherein, in the (e) conveying, the controller is configured to halt conveyance of the second sheet in the second conveying passage at a prescribed position in which a leading edge of the second sheet in the second conveying direction is positioned upstream of the merging position in the second conveying direction and a trailing edge of the second sheet in the second conveying direction is positioned downstream of the branching position in the second conveying direction.

4. The printing device according to claim 3, further comprising a sheet edge sensor configured to detect the leading edge and the trailing edge of the second sheet, and wherein, in the (e) conveying, the controller is configured to halt conveyance of the second sheet at the prescribed position of the second conveying passage based on detection results from the sheet edge sensor.

5. The printing device according to claim 3, further comprising:

a sheet edge sensor disposed along one of the first conveying passage and the second conveying passage, the sheet edge sensor being configured to detect a leading edge and a trailing edge of the sheet; and a conveyance amount sensor configured to detect a conveyance amount of the second sheet, wherein, in the (e) conveying, the controller is configured to convey the second sheet, based on detection results of the leading edge and the trailing edge of the sheet detected by the sheet edge sensor and on a conveyance amount of the second sheet detected by the conveyance amount sensor, to the prescribed position in the second conveying passage.

6. The printing device according to claim 1, further comprising:

a feeding roller configured to feed the sheet mounted on the feeding tray to the first conveying passage;

a first conveying roller disposed along the first conveying passage and configured to convey each of the sheet and the second sheet in the first conveying direction; and a second conveying roller disposed along the second conveying passage and configured to convey the second sheet in the second conveying direction, wherein the controller is configured to further perform:

(g) conveying, after performing the (e) conveying, the second sheet in the second conveying passage to the image recording unit by rotating the second conveying roller and the first conveying roller while halting rotation of the feeding roller.

7. The printing device according to claim 1, further comprising:

a sheet edge sensor configured to detect a leading edge and a trailing edge of the sheet;

an input unit through which information on a size of the sheet is inputted; and a storage, wherein the controller is configured to further perform:

(h) storing information on a size of the second sheet in the storage, the size of the second sheet being specified by information on a width of the sheet included in the information on the size of the sheet inputted through the input unit and information on a length of the second sheet between a leading edge and a trailing edge of the second sheet obtained based on detection results from the sheet edge sensor.

8. The printing device according to claim 7, wherein, when the size of the second sheet indicated by the information stored in the storage satisfies prescribed conditions, the controller is configured to perform the (e) conveying, and wherein, when the size of the second sheet indicated by the information stored in the storage does not satisfy the prescribed conditions, the controller is configured to further perform:

(i) discharging the second sheet to the outside without performing the (e) conveying.

9. The printing device according to claim 7, wherein, when the size of the second sheet indicated by the information stored in the storage is the same as a size of print data specified in a new print job, the controller is configured to further perform:

(j) recording, after performing the (e) conveying, an image on the second sheet using the image recording unit without halting conveyance of the second sheet the second conveying passage.

10. The printing device according to claim 7, further comprising:

a feeding roller configured to feed the sheet mounted on the feeding tray to the first conveying passage;

a first conveying roller disposed along the first conveying passage and configured to convey each of the sheet and the second sheet in the first conveying direction; and a second conveying roller disposed along the second conveying passage and configured to convey each of the sheet and the second sheet in the second conveying direction, wherein, when a new print job specifies duplex printing and when the size of the second sheet indicated by the information stored in the storage is different from a size of print data specified in the new print job, the controller is configured to further perform:

(k) conveying another sheet mounted on the feeding tray to the image recording unit in the first conveying direction;

(l) recording, using the image recording unit, an image on one surface of the another sheet;

(m) discharging, after performing the (l) recording, the second sheet to the outside by rotating the second conveying roller and the first conveying roller while halting rotation of the feeding roller, (n) conveying, while performing the (m) discharging, the another sheet to the second conveying passage; and (o) recording, using the image recording unit, an image on another surface opposite the one surface of the another sheet.

11. The printing device according to claim 10, wherein, after performing the (l) recording, the controller is configured to convey the another sheet in the first conveying direction to a position not overlapping the second sheet.

12. The printing device according to claim 2, further comprising:

an input unit through which information on a type of the sheet is inputted; and a storage configured to store therein information on the type of the sheet inputted through the input unit, wherein, when the information on the type of the sheet stored in the storage indicates that the type of the sheet is a special paper in which one surface and another surface of the sheet have characteristics different from each other, the controller is configured to further perform:

(p) conveying the second sheet to the second conveying passage an even number of times in total to allow the second sheet to pass through the second conveying passage the even number of times in total; and (q) conveying, after performing the (p) conveying, the second sheet to the image recording unit.

13. The printing device according to claim 1, further comprising an input unit through which settings on whether to perform the (e) conveying is inputted, wherein, when settings to perform the (e) conveying have been inputted through the input unit, the controller is configured to perform the (e) conveying, and wherein, when settings not to perform the (e) conveying have been inputted through the input unit, the controller is configured not to perform the (e) conveying.

14. The printing device according to claim 13, wherein settings on whether to use the second sheet conveyed to the second conveying passage in the (e) conveying in a subsequent printing operation are inputted through the input unit, wherein, when settings to use the second sheet in the subsequent printing operation have been inputted through the third input unit, the controller is configured to further perform:

(r) conveying the second sheet to the image recording unit, and wherein, when settings not to use the second sheet in the subsequent printing operation has been inputted through the third input unit, the controller is configured not to perform the (r) conveying.

15. The printing device according to claim 1, further comprising a second sheet sensor configured to detect presence or absence of the second sheet in the second conveying passage.

16. The printing device according to claim 15, wherein, when the second sheet sensor detects that the second sheet is not in the second conveying passage, the controller is configured not to perform conveying the second sheet.

17. The printing device according to claim 15, wherein, when the second sheet sensor detects that the second sheet remains in the second conveying passage after power to the printing device is turned off, the controller is configured to further perform:

(s) discharging the second sheet to the outside.

18. The printing device according to claim 1, wherein the image recording unit comprises:

a recording head configured to eject ink on the sheet to record an image on the sheet; and a carriage configured to reciprocally move the recording head in a direction perpendicular to the first conveying direction, wherein, in the (b) recording, the controller is configured to alternately perform:

(b1) conveying the sheet in the first conveying direction by a prescribed amount; and (b2) ejecting, using the recording head, ink onto the sheet while moving the carriage, conveyance of the sheet being halted while the (b2) ejecting is performed.

* * * * *